US007132911B2

(12) United States Patent
Chung et al.

(10) Patent No.: US 7,132,911 B2
(45) Date of Patent: Nov. 7, 2006

(54) BREAKER FOR PROTECTING ELECTRIC FACILITIES

(76) Inventors: Rong-Lin G Chung, 235 Chung - Ho Box 8-24, Taipei (TW); Tgo-Ing Lin, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 11/042,846

(22) Filed: Jan. 25, 2005

(65) Prior Publication Data

US 2006/0164195 A1 Jul. 27, 2006

(51) Int. Cl.
*H01H 9/00* (2006.01)

(52) U.S. Cl. ..... 335/6; 335/21; 335/24; 335/35; 335/166; 335/172; 335/173; 335/174

(58) Field of Classification Search ..... 335/21–25, 335/35–42, 165–176, 6
See application file for complete search history.

(56) References Cited

U.S. PATENT DOCUMENTS 4,713,636 A * 12/1987 Lemmer et al. ..... 335/35
5,162,765 A * 11/1992 DiVincenzo et al. ..... 335/175
5,300,905 A * 4/1994 Kolbas et al. ..... 335/167
5,300,906 A * 4/1994 Blanchard et al. ..... 335/167
6,642,820 B1 * 11/2003 Emura et al. ..... 335/17
2002/0130742 A1 * 9/2002 Jacq et al. ..... 335/132

* cited by examiner

*Primary Examiner*—Ramon M. Barrera

(57) ABSTRACT

A breaker includes a housing (10) having two terminals (11, 12), two bars (17, 18) electrically coupled to the terminals (11, 12), an arm (30) supported in the housing (10) and movable to engage with the bars (17, 18) to electrically couple the terminals (11, 12) together. A control device (4) may control the arm (30) to engage with the bars (17, 18), and includes a lever (50) to maintain the arm (30) in engagement with the bars (17, 18). A spring (33) may bias the arm (30) away from the bars (17, 18), and another spring (53) may be engaged with the lever (50) to bias and disengage the lever (50) from the arm (30).

1 Claim, 6 Drawing Sheets

BREAKER FOR PROTECTING ELECTRIC FACILITIES

FIELD OF THE INVENTION

The present invention relates to a breaker device for protecting electric facilities from being damaged when electric power supplied to the electric facilities is terminated suddenly.

BACKGROUND OF THE INVENTION

Various kinds of breaker devices have been developed and provided for switching off the electric facilities, and for protecting and preventing the electric facilities from being damaged when the electric power is stop supplying to the electric facilities suddenly, or when the electric power is unstable or is not good enough to energize the electric facilities.

However, when the electric power is supplied to the electric facilities again, a great voltage may be generated within the electric facilities, such that the electric facilities may be easily damaged after the termination of the electric power and when the electric power is supplied to the electric facilities again.

SUMMARY OF THE INVENTION

It is accordingly an object of the utility model to provide a breaker for maintaining the termination situation to the electric power and when the electric power is supplied to the electric facilities again after the sudden termination of the electric power to the electric facilities.

In accordance with the utility model there is provided a breaker comprising a housing having a first and a second terminals. Two bars are electrically coupled to the terminals, an arm is supported in the housing and movable to engage with the bars to electrically couple the terminals together, and a control device is engaged with the arm to control an engagement of the arm with the bars.

The arm includes a cavity, the control device includes a lever having one end engageable into the cavity of the arm to maintain the engagement of the arm with the bars.

A spring is engaged with the arm to bias the arm away from the bars hen the end of the lever is disengaged from the cavity of the arm.

A spring is engaged with the lever to bias and disengage the end of the lever from the cavity of the arm.

The control device includes a stator, a core having one end for engaging with the lever, and a coil for controlling the end of the core toward and away from the lever.

A conductor is rotatably supported in the housing, and a handle is coupled to the conductor, to move the conductor toward and away from the first terminal.

The various objects and advantages of the present invention will be more readily understood from the following detailed description when read in conjunction with the appended drawing.

DETAILED DESCRIPTION OF THE PREFRRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
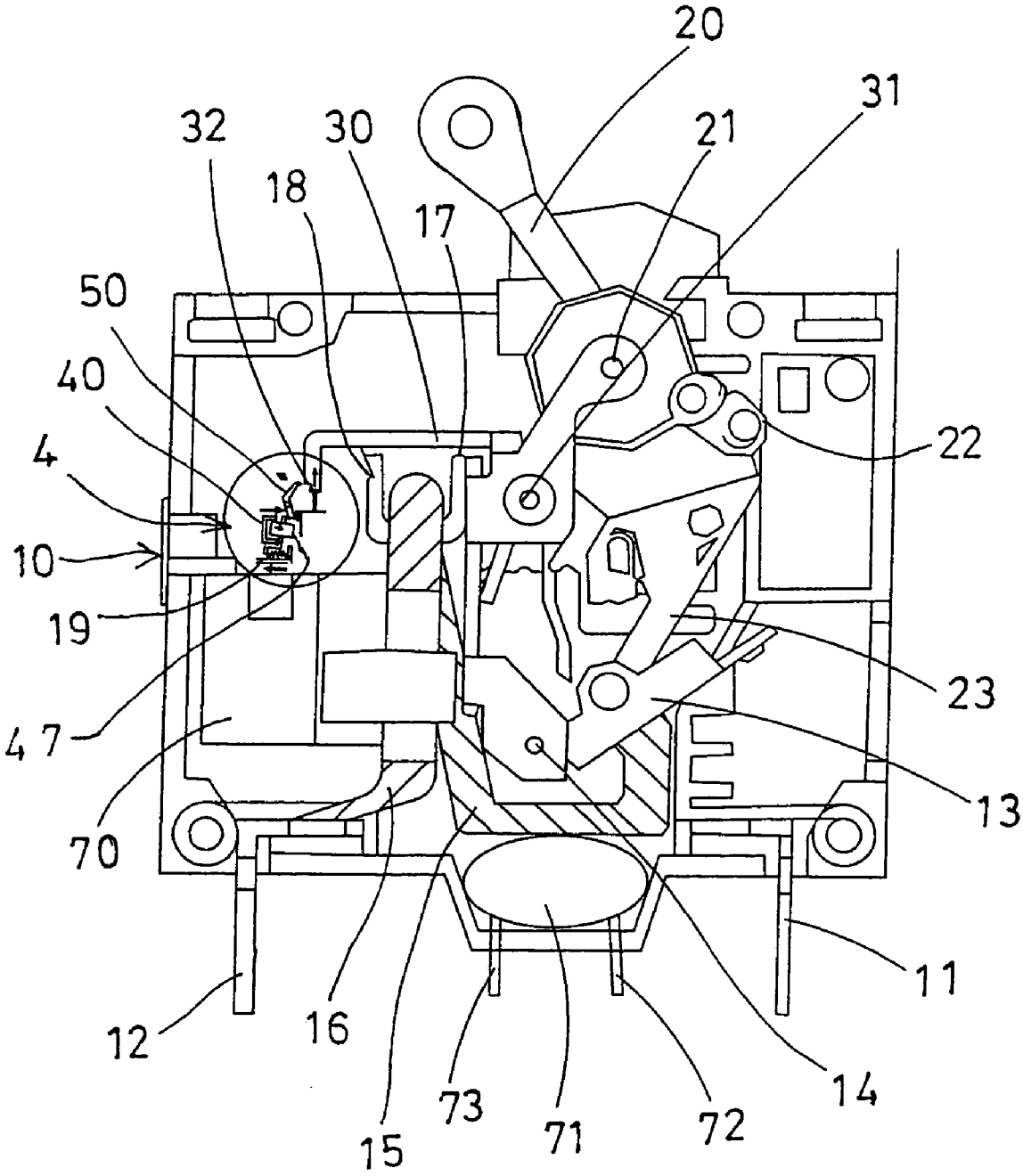
FIG. 1 is a partial cross sectional view of a breaker.
Figure 2:
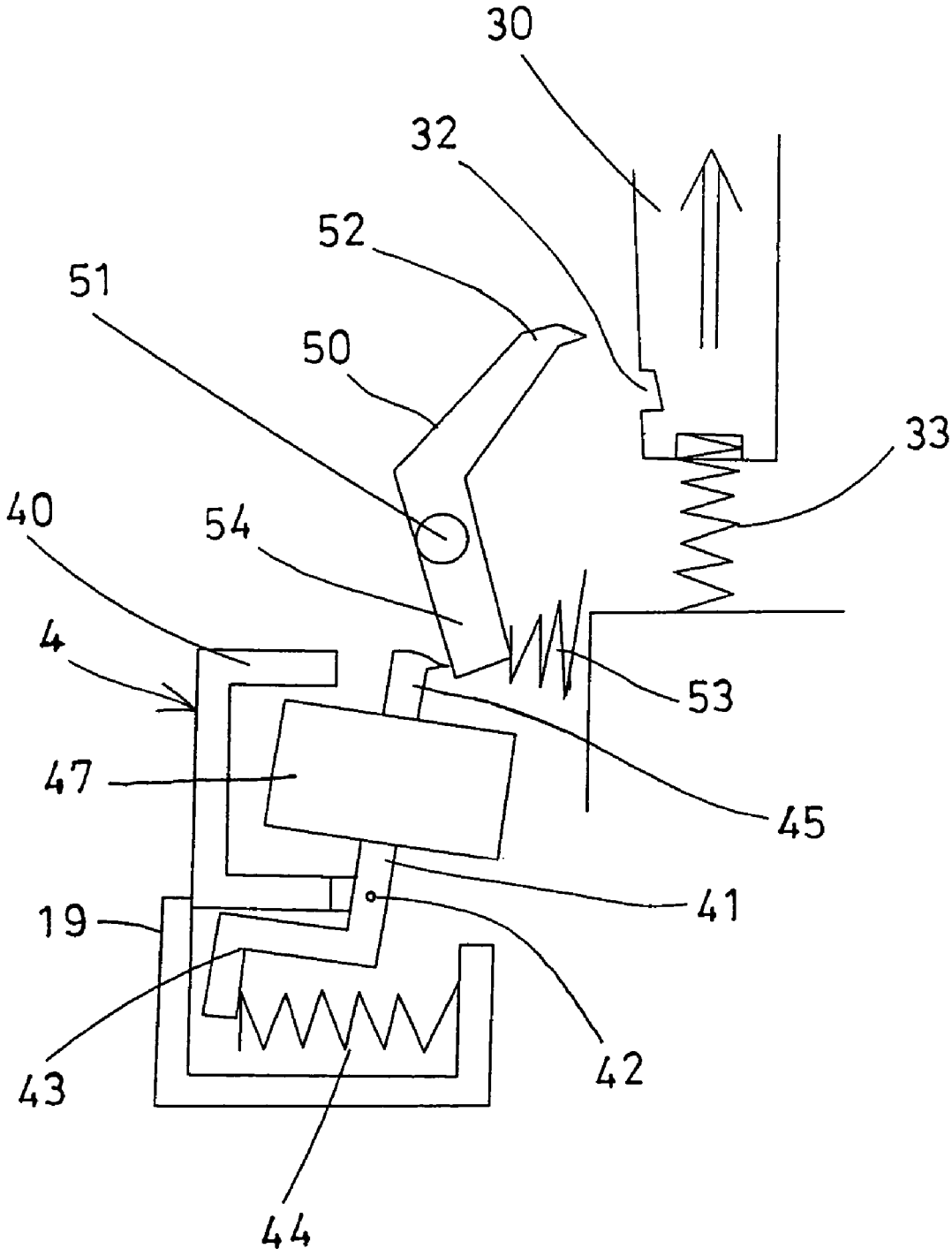
FIG. 2 is an enlarged partial plan schematic view of the breaker.
Figure 3:
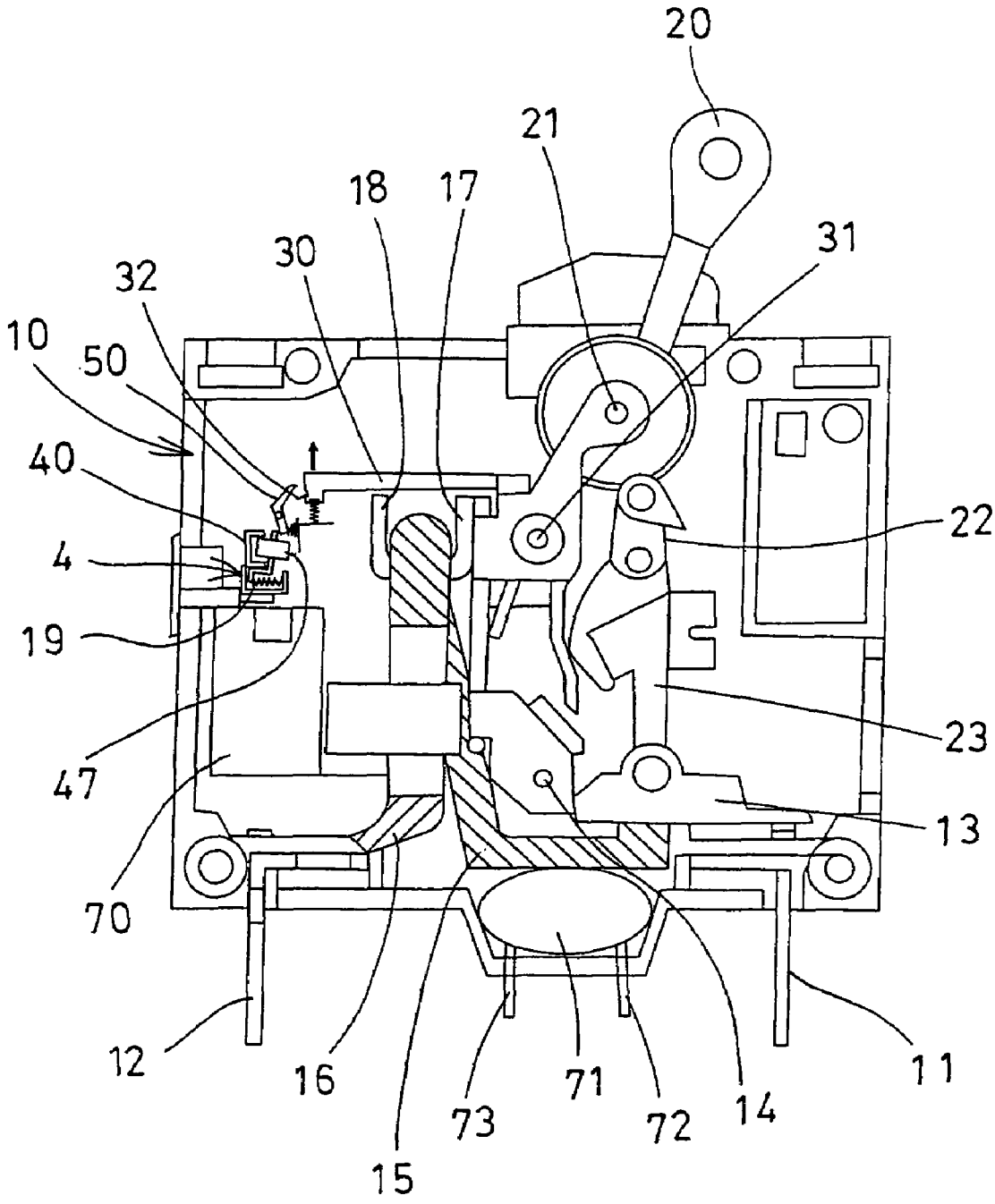
FIGS. 3, 4 are partial cross sectional views similar to FIG. 1, illustrating the operation of the breaker.

Referring to FIGS. 1 and 2, a breaker comprises a housing 10 including two terminals 11, 12 for coupling to electric facilities that are required to be protected, and a conductor 13 is rotatably supported in the housing 10 with a pivot shaft 14, and rotatable away from the terminal 11 (FIGS. 1 and 4), and rotatable to engage with the terminal 11 (FIG. 3).

Two links 15, 16 are further provided and supported in the housing 10, and electrically coupled to the conductor 13 and the terminal 12 respectively, and two further bars 17, 18 also supported in the housing 10. The bars 17, 18 are electrically coupled to the links 15, 16 respectively, and are spaced and separated away from each other.

A handle 20 is rotatably or pivotally secured to the housing 10 with a pivot axle 21, and includes an extension 22 extended therefrom, and a beam 23 coupled between the extension 22 of the handle 20 and the conductor 13, for moving the conductor 13 away from the terminal 11 (FIGS. 1 and 4) or toward and to engage with the terminal 11 (FIG. 3).

An arm 30 includes one end rotatably or pivotally secured to the housing 10 with a pivot pin 31, and includes a cavity 32 formed in the other end thereof. The arm 30 is rotatable downwardly to engage with the bars 17, 18 (FIG. 4), and thus to electrically couple the links 15, 16 and the terminals 11, 12 with each other. A spring 33 is engaged with the other end of the arm 30, for biasing and disengaging the arm 30 from the bars 17, 18.

Figure 5:
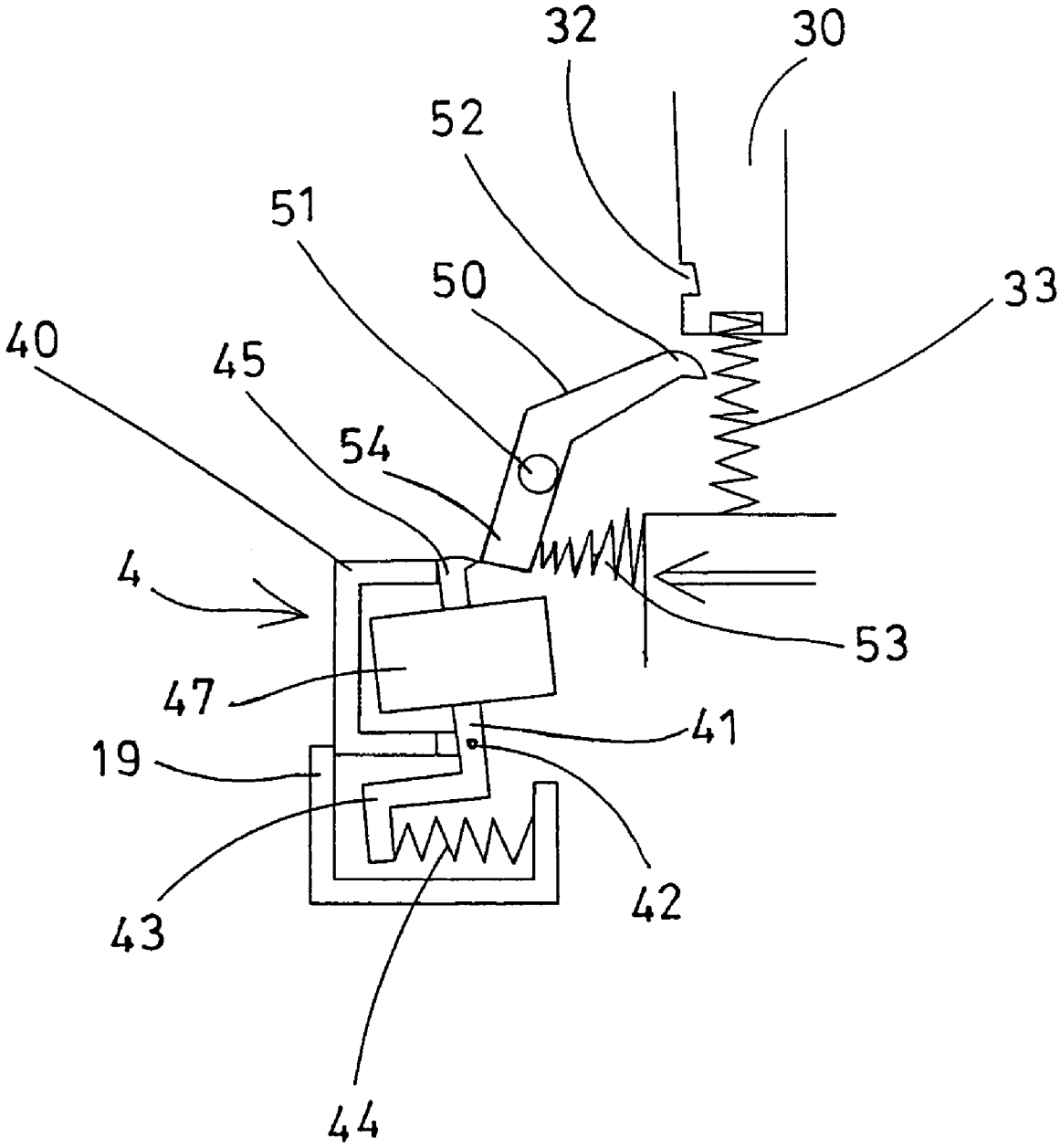
FIGS. 5, 6, 7 are enlarged partial plan schematic views similar to FIG. 2, illustrating the operation of the breaker.
Figure 7:
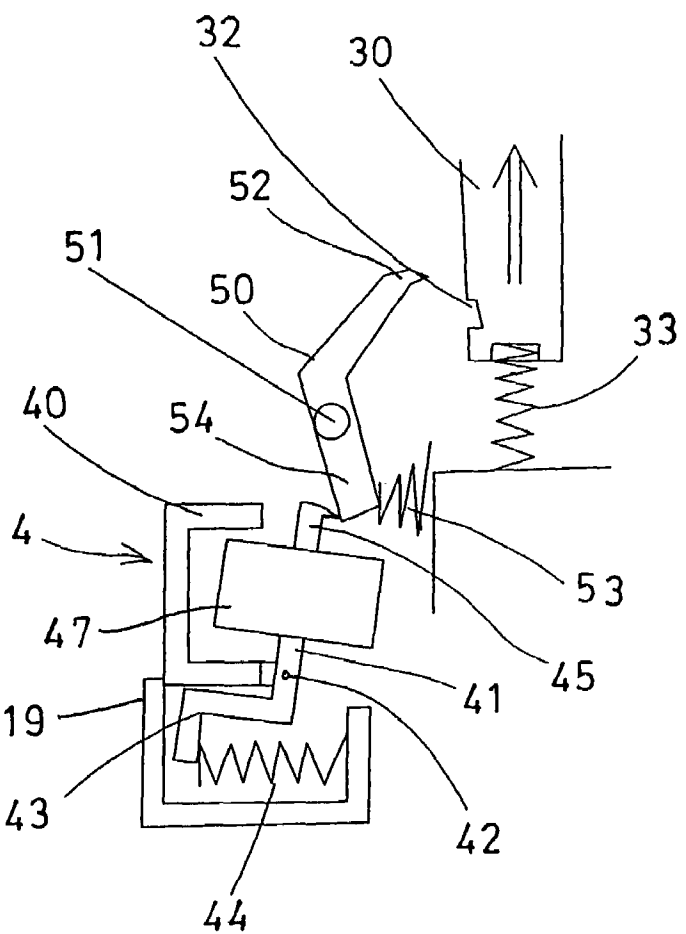
Figure 6:
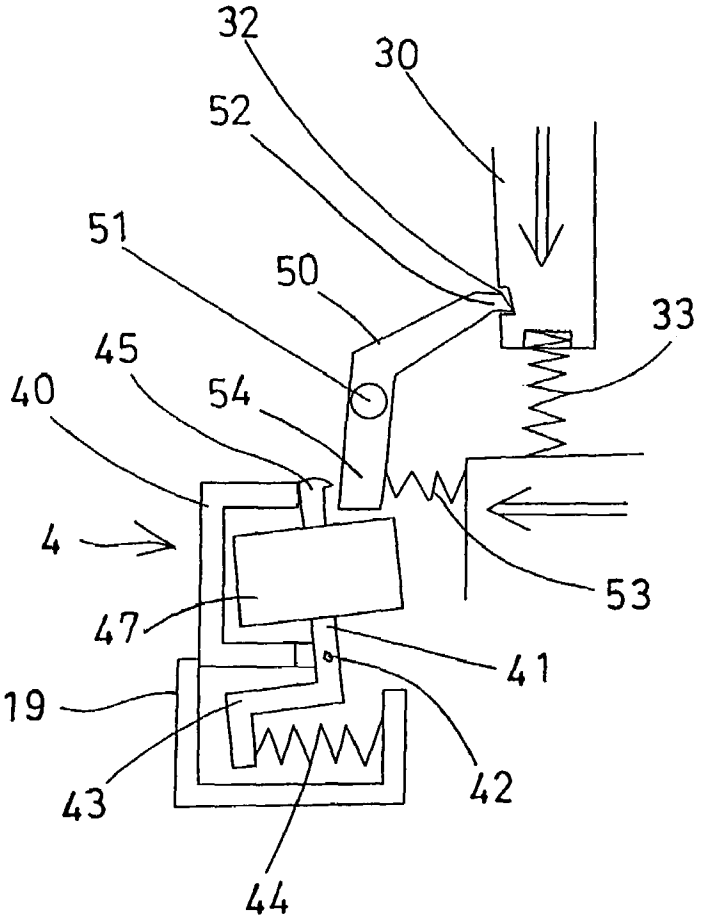

A control device 4 is disposed in the housing 10, and includes a stator 40 secured on a seat 19 of the housing 10. As shown in FIGS. 2 and 5–7, a core 41 has a middle portion pivotally secured to the seat 19 or the housing 10 with a pivot rod 42, and has one end 43 engaged with a spring 44 which may bias the other end 45 of the core 41 away from the stator 40 (FIGS. 2, 7). A coil 47 is attached onto the core 41, for generating a magnetic force to force the other end 45 of the core 41 to engage with the stator 40 (FIGS. 5, 6).

Figure 4:
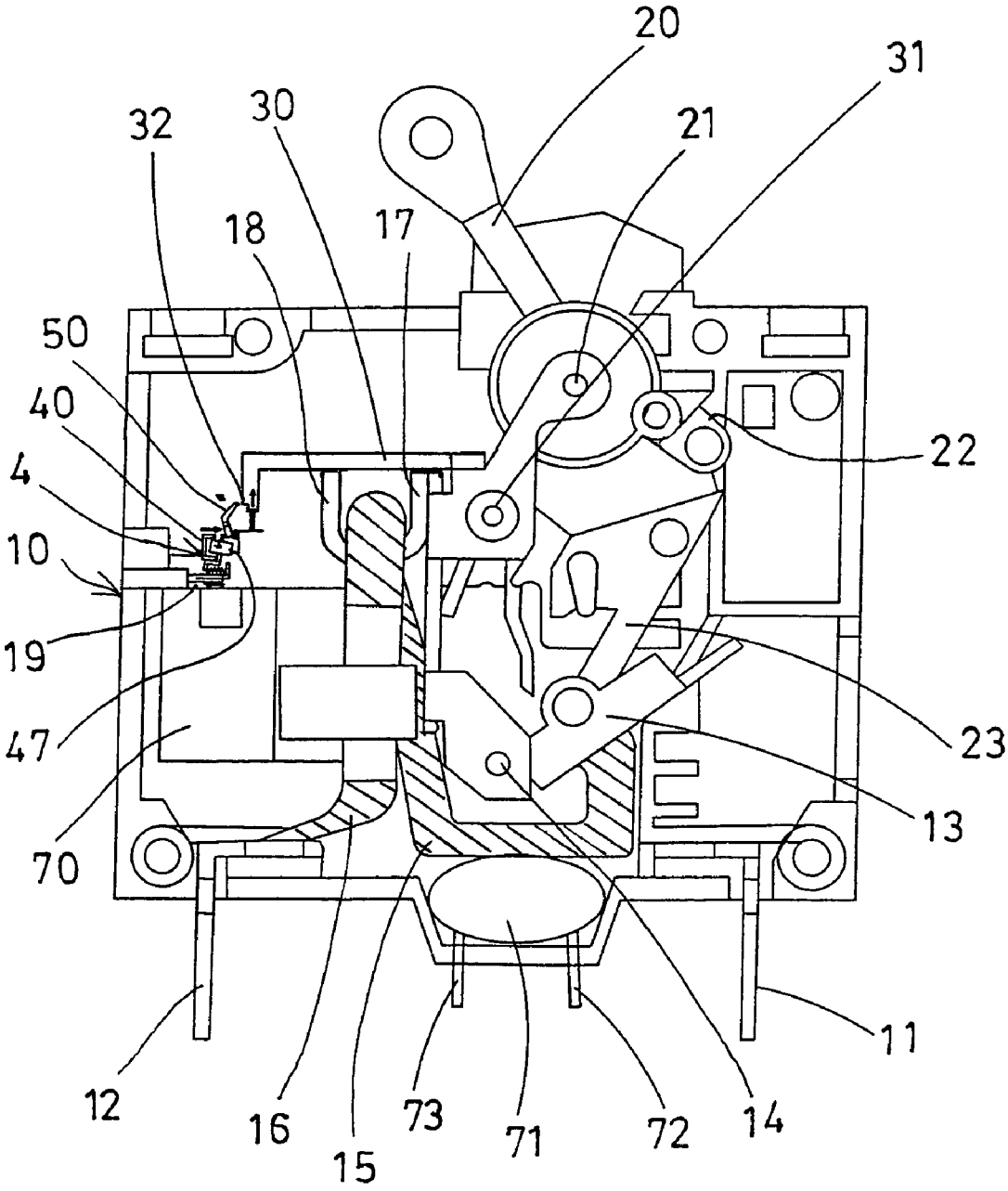

A lever 50 has a middle portion pivotally secured to the seat 19 or the housing 10 with a pivot pole 51, and has one end 52 for engaging into the cavity 32 of the arm 30, and another spring 53 engaged with the other end 54 of the spring 53, for biasing the end 52 of the lever 50 to engage into the cavity 32 of the arm 30 (FIG. 6), and thus to maintain the electrical engagement of the arm 30 with the bars 17, 18 (FIG. 4).

A processor device 70 may be used to control the operation of the control device 4, and includes a power supply device 71 having two prongs 72, 73 for coupling to electric power source, and coupled to the processor device 70, for energizing the processor device 70.

In operation, the conductor 13 may be moved away from the terminal 11 in order to terminate or switch off the electric coupling between the terminals 11, 12, when the handle 20 is moved leftward (FIGS. 1, 4), and the conductor 13 may be moved to engage with the terminal 11 in order to electrically couple the terminals 11, 12 together, when the handle 20 is moved rightward (FIG. 3).

As shown in FIG. 4, when the arm 30 is rotated to engage with the bars 17, 18, and to electrically couple the links 15, 16 and the terminals 11, 12 with each other, the conductor 13 is still disengaged from the terminal 11, such that the electric coupling between the terminals 11, 12 is still terminated or switched off.

As shown in FIG. 5, when the coil 47 is energized to force the other end 45 of the core 41 to engage with the stator 40, the spring 53 may bias the other end 54 of the spring 53 toward the stator 40. When the arm 30 is depressed downward against the spring 33, the end 52 of the lever 50 may be biased by the spring 53 to engage into the cavity 32 of the arm 30 (FIG. 6), in order to maintain the electrical engagement of the arm 30 with the bars 17, 18 (FIG. 4).

When the electric power supplied to the terminals 11, 12 and to the prongs 72, 73 is terminated or switched off, as shown in FIG. 7, the coil 47 may also be switched off, and the spring 44 may bias the other end 45 of the core 41 away from the stator 40 (FIGS. 2, 7), and may bias the other end 54 of the lever 50 against the spring 53, such that the end 52 of the lever 50 may be released and disengaged from the cavity 32 of the arm 30, and such that the arm 30 may be biased by the spring 33 and disengaged from the bars 17, 18, and to switch off the electrical coupling between the links 15, 16 and the terminals 11, 12.

When the electric power is supplied to the terminals 11, 12 again, the arm 30 may still be biased by the spring 33 and disengaged from the bars 17, 18, such that the electrical coupling between the links 15, 16 and the terminals 11, 12 may still be maintained in the switched off situation.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A breaker comprising a housing (10) including a first and a second terminals (11, 12) for coupling to electric facilities that are required to be protected, and a conductor (13) being rotatably supported in the housing (10) with a pivot shaft (14), and rotatable away from the first terminal (11), and rotatable to engage with the terminal (110);

two links (15, 16) supported in the housing (10), and electrically coupled to the conductor (13) and the terminal (12) respectively, two bars (17, 18) being supported in the housing (10); the bars (17, 18) being electrically coupled to the links (15, 16) respectively, and being spaced and separated away from each other;

a handle (20) pivotally secured to the housing (10) with a pivot axle (21), and including an extension (22) extended therefrom, and a beam (23) coupled between the extension (22) of the handle (20) and the conductor (13), for moving the conductor (13) away from the first terminal (11);

an arm (30) having one end pivotally secured to the housing (10) with a pivot pin (31), and having a cavity (32) formed in the other end thereof; the arm (30) being rotatable downwardly to engage with the two bars (17, 18), and thus to electrically couple the two links (15, 16) and the first and second terminals (11, 12) with each other; a spring (33) being engaged with the other end of the arm (30), for biasing and disengaging the arm (30) from the bars (17, 18);

a control device (4) disposed in the housing (10), and including a stator (40) secured on a seat (19) of the housing (10), a core (41) having a middle portion pivotally secured to the seat (19) of the housing (10) with a pivot rod (42), and having one end (43) engaged with a spring (44) which may bias the other end (45) of the core (41) away from the stator (40); a coil (47) being attached onto the core (41), for generating a magnetic force to force the other end (45) of the core (41) to engage with the stator (40);

a lever (50) having a middle portion pivotally secured to the seat (19) of the housing (10) with a pivot pole (51), and having one end (52) for engaging into the cavity (32) of the arm (30), and another spring (53) engaged with the other end (54) of the lever (50), for biasing the end (52) of the lever (50) to engage into the cavity (32) of the arm (30), and thus to maintain the electrical engagement of the arm (30) with the bars (17, 18);

a processor device (70) for controlling the operation of the control device (4), and including a power supply device (71) having two prongs (72), (73) for coupling to electric power source, and coupled to the processor device (70), for energizing the processor device (70)

wherein in operation, when the handle (20) moves leftward, the conductor (13) moves away from the one of the two terminals (11) in order to terminate or switch off the electric coupling between the first and second terminals (11, 12), and when the handle (20) moves rightward, the conductor (13) moves to engage with one of the two the first terminal (11) in order to electrically couple the first and second terminals (11, 12) together;

wherein when the arm (30) is rotated to engage with the bars (17, 18), and to electrically couple the links (15, 16) and the first and second terminals (11, 12) with each other, the conductor (13) is still disengaged from the first terminal (11), such that the electric coupling between the first and second terminals (11, 12) is still terminated or switched off;

wherein when the coil (47) is energized to force the other end (45) of the core (41) to engage with the stator (40), the spring (53) biases the other end (54) of the lever (50) toward the stator (40); when the arm (30) is depressed downward against the spring (33), the end (52) of the lever (50) may be biased by the spring (53) to engage into the cavity (32) of the arm (30), in order to maintain the electrical engagement of the arm (30) with the bars (17, 18);

when the electric power supplied to the first and second terminals (11, 12) and to the prongs (72, 73) is terminated or switched off, the coil (47) being switched off, and the spring (44) biases the other end (45) of the core (41) away from the stator (40), and biases the other end (54) of the lever (50) against the spring (53), such that the end (52) of the lever (50) is released and disengaged from the cavity (32) of the arm (30), and such that the arm (30) may be biased by the spring (33) and disengaged from the bars (17, 18), and to switch off the electrical coupling between the links (15, 16) and the first and second terminals (11, 12); and when the electric power is supplied to the first and second terminals (11, 12) again, the arm (30) is biased by the spring (33) and disengaged from the bars (17, 18), such that the electrical coupling between the links (15, 16) and the first and second terminals (11, 12) is maintained in the switched off situation.

* * * * *